US009452611B2

(12) United States Patent
Kimura et al.

(10) Patent No.: US 9,452,611 B2
(45) Date of Patent: Sep. 27, 2016

(54) HOLDING MEMBER FOR LIQUID STORAGE CONTAINER, LIQUID EJECTION HEAD, AND PRINTER

(71) Applicant: CANON KABUSHIKI KAISHA, Tokyo (JP)

(72) Inventors: Satoshi Kimura, Kawasaki (JP); Tomotsugu Kuroda, Yokohama (JP); Kyosuke Toda, Kawasaki (JP); Naoko Tsujiuchi, Kawasaki (JP); Kiyomitsu Kudo, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/830,160

(22) Filed: Aug. 19, 2015

(65) Prior Publication Data

US 2016/0052283 A1 Feb. 25, 2016

(30) Foreign Application Priority Data

Aug. 25, 2014 (JP) ..... 2014-170353

(51) Int. Cl.
*B41J 2/175* (2006.01)

(52) U.S. Cl.
CPC ..... *B41J 2/1752* (2013.01); *B41J 2/17523* (2013.01)

(58) Field of Classification Search
CPC .... B41J 2/175; B41J 2/17509; B41J 2/1752; B41J 2/17513; B41J 2/17523; B41J 2/17553
USPC ..... 347/49, 86, 108
See application file for complete search history.

(56) References Cited

U.S. PATENT DOCUMENTS

| | | | | |
|---|---|---|---|---|
| 5,619,237 | A | 4/1997 | Inoue et al. | |
| 5,671,000 | A * | 9/1997 | Hirabayashi | B41J 2/17526 347/50 |
| 5,798,777 | A * | 8/1998 | Yoshimura | B41J 2/16505 347/29 |
| 6,199,977 | B1 * | 3/2001 | Komplin | B41J 2/17503 347/86 |
| 6,250,750 | B1 * | 6/2001 | Miyazawa | B41J 2/17513 347/86 |
| 6,302,535 | B1 | 10/2001 | Sturgeon et al. | |

(Continued)

FOREIGN PATENT DOCUMENTS

| | | |
|---|---|---|
| CA | 2 209 866 C | 12/2003 |
| CA | 2 432 674 A1 | 12/2003 |

(Continued)

OTHER PUBLICATIONS

Office Action dated Jul. 21, 2016, in corresponding Chinese Application No. 201510516423.3.

*Primary Examiner* — Anh T. N. Vo
(74) *Attorney, Agent, or Firm* — Fitzpatrick, Cella, Harper & Scinto

(57) ABSTRACT

A holding member for a liquid storage container includes: a mounting portion for removably mounting the liquid storage container through an opening along a predetermined direction; and a locking member for locking the mounted liquid storage container to the mounting portion by being fitted to the liquid storage container, wherein the mounting portion has a regulating portion for regulating inclination of a posture of the liquid storage container relative to the predetermined direction at the time of mounting the liquid storage container, the regulating portion being a portion provided such that a space between an inner surface of the mounting portion and an outer surface facing thereto of the liquid storage container is partially narrowed along a direction of insertion.

16 Claims, 6 Drawing Sheets

(56) References Cited

U.S. PATENT DOCUMENTS

| | | | | |
|---|---|---|---|---|
| 6,375,315 | B1 | 4/2002 | Steinmetz et al. | |
| 6,390,601 | B1 | 5/2002 | Morita et al. | |
| 6,431,697 | B1 | 8/2002 | King et al. | |
| 6,488,369 | B1 | 12/2002 | Steinmetz et al. | |
| 6,508,547 | B2 | 1/2003 | King et al. | |
| 7,018,027 | B2 | 3/2006 | Harada et al. | |
| 7,178,909 | B2 * | 2/2007 | Yoshiyama | B41J 2/1752 347/49 |
| 7,213,914 | B2 | 5/2007 | Anma et al. | |
| 7,237,881 | B2 | 7/2007 | Hayasaki et al. | |
| 7,278,721 | B2 | 10/2007 | Shimizu et al. | |
| 7,293,864 | B2 | 11/2007 | Kimura et al. | |
| 7,350,910 | B2 | 4/2008 | Amma et al. | |
| 7,438,401 | B2 | 10/2008 | Seino et al. | |
| 7,562,972 | B2 * | 7/2009 | Hattori | B41J 2/17513 347/19 |
| 7,784,906 | B2 * | 8/2010 | Umeda | B41J 2/17509 347/49 |
| 7,806,523 | B2 | 10/2010 | Seino et al. | |
| 8,297,738 | B1 | 10/2012 | Kodama et al. | |
| 8,297,739 | B1 | 10/2012 | Kodama et al. | |
| 8,439,482 | B1 | 5/2013 | Kodama et al. | |
| 8,454,141 | B2 | 6/2013 | Matsumoto et al. | |
| 8,708,469 | B2 | 4/2014 | Kodama et al. | |
| 8,752,944 | B2 | 6/2014 | Nozawa et al. | |
| 8,807,721 | B2 | 8/2014 | Nozawa et al. | |
| 8,915,582 | B2 | 12/2014 | Kodama et al. | |
| 9,039,153 | B2 | 5/2015 | Matsuzaki et al. | |
| 2005/0036015 | A1 | 2/2005 | Seino et al. | |
| 2005/0052511 | A1 | 3/2005 | Seino et al. | |

FOREIGN PATENT DOCUMENTS

| | | | |
|---|---|---|---|
| CN | 1179385 | A | 4/1998 |
| CN | 1212207 | A | 3/1999 |
| CN | 1410275 | A | 4/2003 |
| CN | 1636745 | A | 7/2005 |
| CN | 1746031 | A | 3/2006 |
| CN | 101134397 | A | 3/2008 |
| CN | 103442895 | A | 12/2013 |
| EP | 0 551 752 | A2 | 7/1993 |
| JP | 2001-253087 | A | 9/2001 |
| JP | 2008-110577 | A | 5/2008 |

* cited by examiner

HOLDING MEMBER FOR LIQUID STORAGE CONTAINER, LIQUID EJECTION HEAD, AND PRINTER

BACKGROUND OF THE INVENTION

1. Field of the Invention

The present invention relates to a printer performing printing by applying a liquid on a medium, and more specifically to a holding member for a liquid storage container for removably mounting the liquid storage container which supplies the liquid to be applied.

2. Description of the Related Art

A printer which has a holding member for removably mounting a liquid storage container and which performs printing with a liquid supplied from the liquid storage container mounted on the holding member has been known.

Japanese Patent Laid-Open No. 2008-110577, for example, discloses a holding member for a liquid storage container for use in a liquid ejection head for applying a liquid on a medium. As a liquid supply mechanism, the holding member and the liquid storage container have a liquid supply needle which is to be inserted into the liquid storage container and a liquid supply port into which the liquid supply needle is inserted, respectively. Through the liquid supply needle of the holding member inserted into the liquid supply port of the liquid storage container, the liquid is supplied to the liquid ejection head. Inserting the liquid storage container into an interior space of the holding member to engage both the liquid supply mechanisms with each other at a locking position enables the supply of the liquid. The holding member has a locking member, for example, in a shape of a nail, so as to lock the liquid storage container at the locking position, and the liquid storage container has a complementary locking mechanism such as an engagement member, for example, in a shape of a recess, which engages with the locking member.

SUMMARY OF THE INVENTION

The inner dimension of the holding member into which the liquid storage container is inserted is formed to be larger than the outer dimension of the liquid storage container, which creates a space between an outer surface of the liquid storage container and an inner surface facing thereto of the holding member. Depending on a direction of pressing at the time of insertion of the liquid storage container into an interior of the holding member, the liquid storage container can be inserted with inclination relative to an intended direction of insertion and bumps into an inner wall of the holding member with a posture which does not allow the locking mechanisms to engage with each other, thus occasionally failing to be mounted.

An object of the present invention is to provide a holding member for a liquid storage container, in which mounting of the liquid storage container can be performed by surely inserting the liquid storage container to the locking position irrespective of the direction of pressing at the time of insertion, and a liquid ejection head and a printer which use the holding member.

A holding member for a liquid storage container of the present invention for achieving the above object includes: a mounting portion for removably mounting the liquid storage container through an opening along a predetermined direction; and a locking member for locking the mounted liquid storage container to the mounting portion by being fitted to the liquid storage container, wherein the mounting portion has a regulating portion for regulating inclination of a posture of the liquid storage container relative to the predetermined direction at the time of mounting the liquid storage container, the regulating portion being a portion provided such that a space between an inner surface of the mounting portion and an outer surface facing thereto of the liquid storage container is partially narrowed along a direction of insertion.

According to the present invention, mounting of the liquid storage container can be performed by surely inserting the liquid storage container to the locking position irrespective of the direction of pressing at the time of insertion.

Further features of the present invention will become apparent from the following description of exemplary embodiments (with reference to the attached drawings).

DESCRIPTION OF THE EMBODIMENTS

Figure 1A:
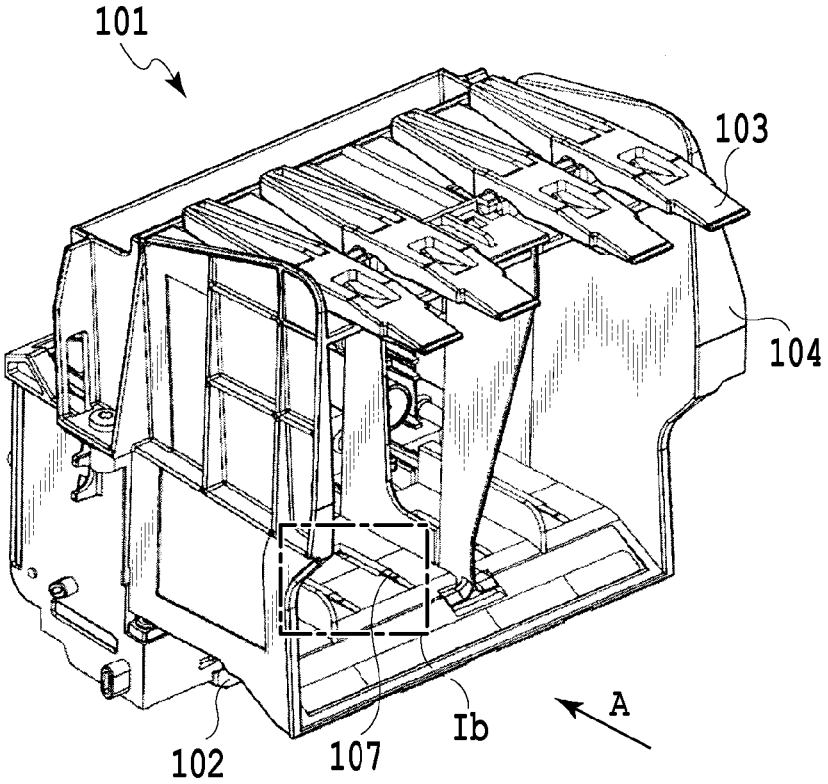
FIG. 1A is a schematic perspective view of a head according to an embodiment.

An embodiment of the present invention will be described below with reference to the attached drawings. In the drawings, the same constituent elements are denoted by the same reference numerals and overlapping explanations are omitted.

(Printer)

Figure 6:
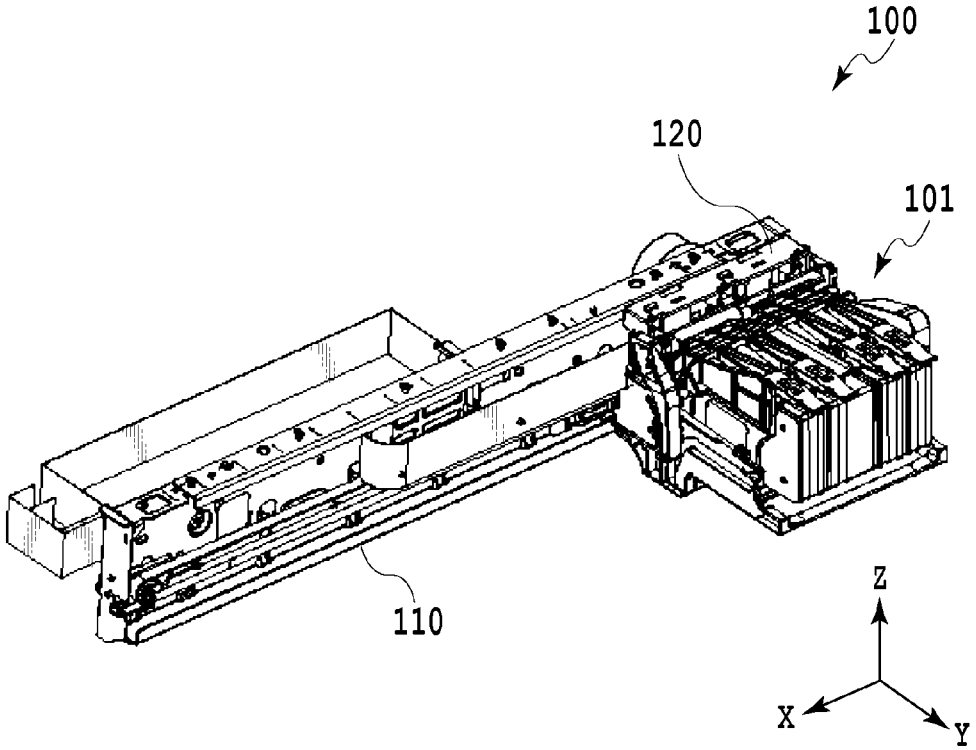
FIG. 6 is a schematic perspective view showing an example of a printer according to the embodiment.

FIG. 6 is a schematic perspective view showing an example of a printer according to an embodiment of the present invention. In this example, a printer 100 adopts an ink jet system in which printing is performed by ejecting a liquid such as ink through a nozzle unit of a liquid ejection head (hereinafter also referred to simply as a head) 101.

The printer 100 has a guide rail 110 and a carriage 120 which performs scanning along the guide rail 110 in a direction indicated by an arrow X (a direction X) in the drawing. The carriage 120 is mounted with the head 101 such that the nozzle unit faces a medium on which printing is performed. The printer 100 ejects, from the head 101, a liquid such as ink in a direction (a direction −Z) opposite to a direction (a direction Z) indicated by an arrow Z while causing the carriage 120 to perform scanning, thereby applying the liquid on the medium which faces the head 101. The medium is conveyed, by a conveyance unit (not shown), in a conveyance direction (a direction Y) indicated by an arrow Y in the drawing. The application of the liquid on the medium and conveyance of the medium are appropriately performed so as to print an image on the medium.

(Liquid Ejection Head)

Figure 1B:
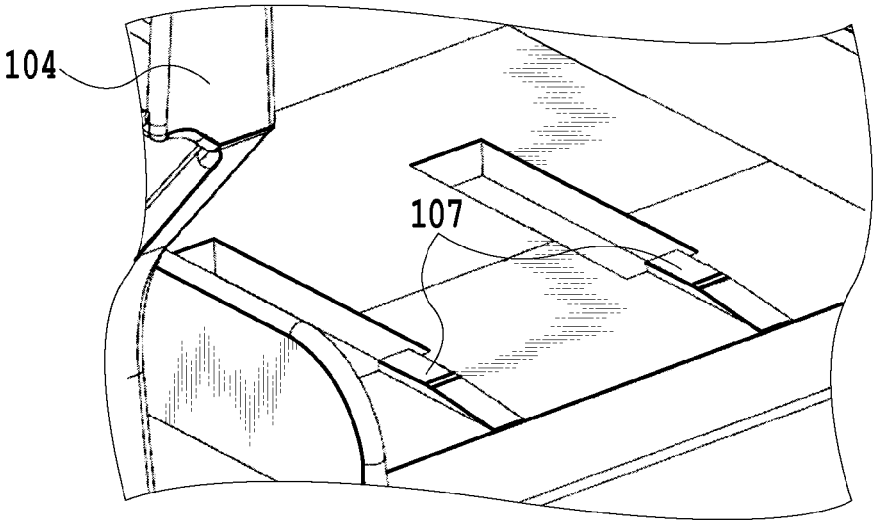
FIG. 1B is an enlarged view of a portion Ib indicated in FIG. 1A.

FIG. 1A is a schematic perspective view of the liquid ejection head according to the embodiment of the present invention and FIG. 1B is an enlarged view of a portion indicated by a square Ib enclosed with a dashed line in FIG. 1A. The liquid ejection head (hereinafter also referred to simply as the head) 101 according to the present embodiment adopts the ink jet system and has a nozzle unit 102 for ejecting a liquid and a holding member (a mounting portion) 104 for holding a liquid storage container which stores the liquid to be ejected.

The head 101 ejects, through the nozzle unit 102 in which apertures of nozzles are arranged, a liquid such as ink onto a medium such as paper which is positioned facing the nozzle unit 102 to apply the liquid and print an image on the medium.

(Holding Member)

The holding member 104 has an opening and interior space for insertion of the liquid storage container. In the interior space of the holding member 104, the liquid storage container which stores the liquid to be supplied to the nozzle unit 102 is removably mounted along a predetermined direction. The holding member 104 has a locking member 103 for locking the mounted liquid storage container at a locking position by performing, for example, fitting, and a regulating portion 107 for regulating a posture of the liquid storage container at the time of insertion of the liquid storage container to the locking position.

Figure 2:
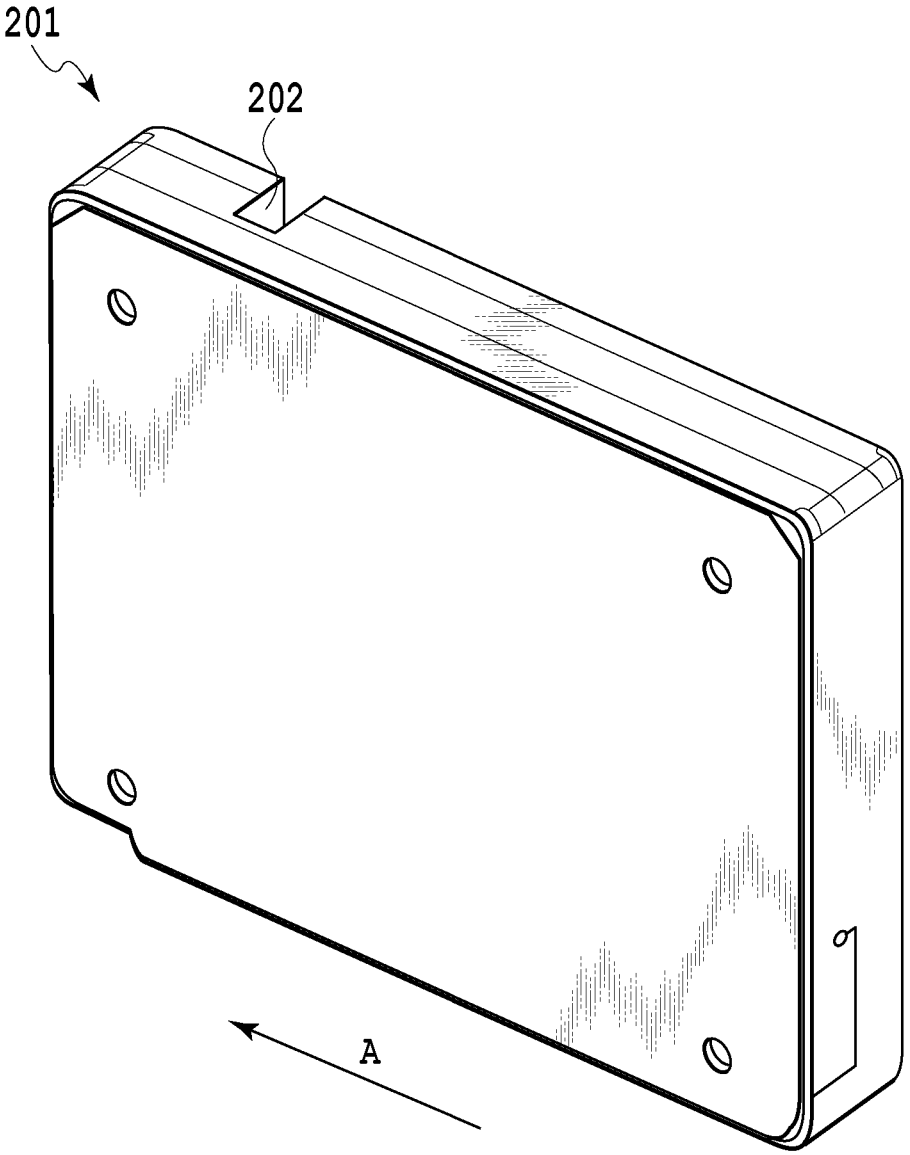
FIG. 2 is a perspective view of a liquid storage container for use in the head according to the embodiment.

FIG. 2 is a perspective view showing an example of the liquid storage container removably mounted on the holding member 104 of the liquid ejection head 101 according to the embodiment of the present invention. A liquid storage container 201 is substantially in a cuboid shape, one of the sides thereof having a recess 202 which creates a locking state by engaging with the locking member 103 at the locking position, once the liquid storage container 201 is inserted into the holding member 104. The liquid storage container 201 is inserted through the opening of the holding member 104 in a direction indicated by an arrow A in the drawing to be mounted on the interior space of the holding member 104.

FIGS. 3A to 3C and FIG. 4 are schematic cross-sectional views explaining mounting of the liquid storage container 201 on the holding member 104 according to the embodiment of the present invention.

Figure 3A:
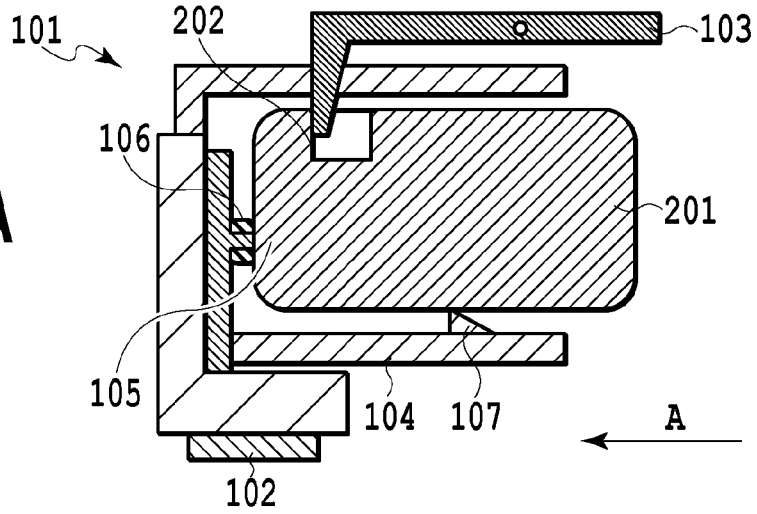
FIGS. 3A to 3C are schematic views explaining mounting of the liquid storage container on the head according to the embodiment.

FIG. 3A shows a state in which the liquid storage container 201 is mounted on the holding member 104 according to the embodiment of the present invention.

The holding member 104 has a biasing member 106 which biases the inserted liquid storage container 201 toward a direction (a direction −A) opposite to a direction of insertion (a direction A) indicated by an arrow A. The biasing member 106 may be, for example, a coil spring.

In the process of mounting, once the liquid storage container 201 is being inserted in the direction A to reach around the locking position, the locking member 103 falls down into the recess 202 of the liquid storage container 201, thereby bringing the locking member 103 and the recess 202 into a loose-fit state. The liquid storage container 201 is biased, by the biasing member 106, toward the direction (the direction −A) opposite to the direction of insertion, and whereby the recess 202 of the liquid storage container 201 and the locking member 103, which are in the loose-fit state, are brought into abutment with each other to be locked so as to maintain the state of mounting. It should be noted that a position of the locking member 103 at this time is called a lock position, while a position of the locking member 103 in a state in which the liquid storage container 201 is insertable into and removable from the holding member 104 is called a lock releasing position. The locking member 103 may be manually moved from the lock position to the lock releasing position.

The head 101 has a liquid supply needle 105 on an inner surface on a rear side in the holding member 104 in the direction of insertion (the direction A) of the liquid storage container 201. At the locking position, the liquid supply needle 105 is inserted into a liquid supply port of the liquid storage container 201 so as to be capable of being in fluid communication and supplies the liquid in the liquid storage container 201 into the head 101. The liquid supplied into the head 101 is led to the nozzle unit 102 to be ejected through the nozzle unit 102 in accordance with an electrical signal.

Figure 3B:
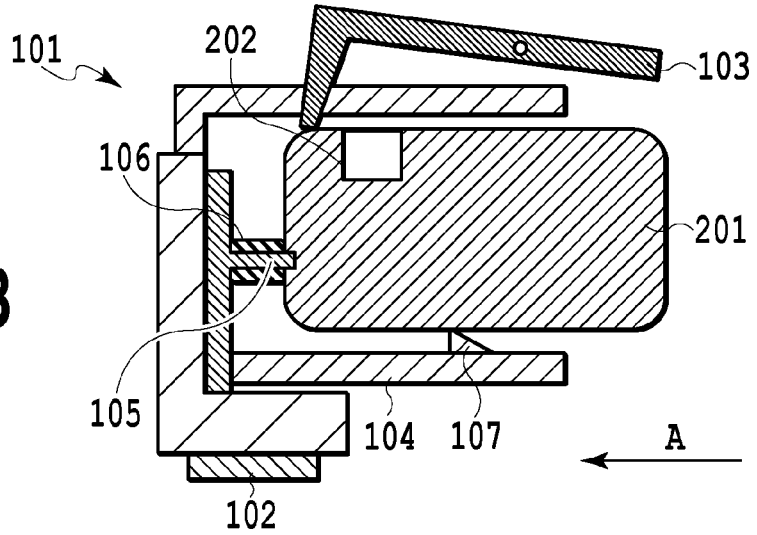

FIG. 3B shows a state in the middle of mounting the liquid storage container 201 on the holding member 104 according to the embodiment of the present invention.

The liquid storage container 201 is inserted, through the opening of the holding member 104, into the interior space of the holding member 104. The holding member 104 is provided with the locking member 103, in such a manner as to project inwardly, on the side of a surface (an inner wall) thereof facing a surface with the recess of the liquid storage container 201 to be inserted and the interior of the holding member 104 is provided with the regulating portion 107 on a surface (a bottom surface of the inner wall) thereof opposite to the surface (an upper surface of the inner wall) thereof on the side of which the locking member 103 is provided. The regulating portion 107 is preferably provided on a surface (the inner wall) of the holding member 104, the surface facing a lower surface of the liquid storage container 201 in the gravity direction in the posture in use. In a case where the liquid storage container 201 is inserted into the interior space of the holding member 104, the inner wall of the holding member 104 and the regulating portion 107 provided thereon regulate the posture of the liquid storage container 201.

Figure 3C:
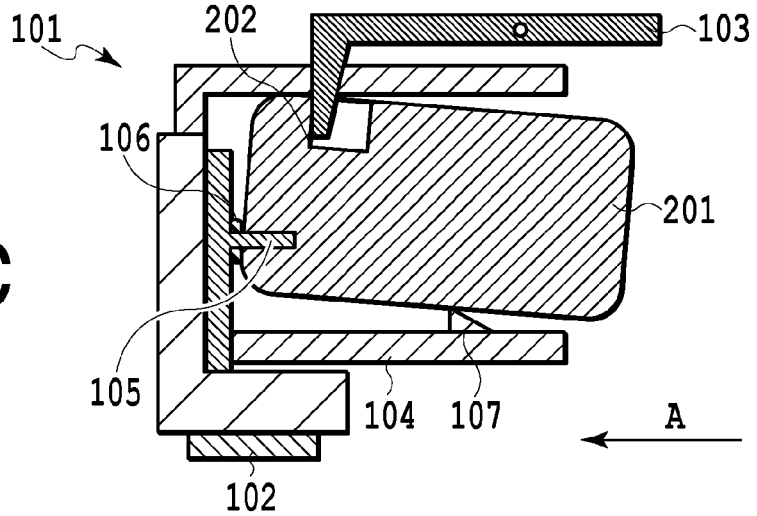

FIG. 3C shows a state in which the liquid storage container 201 is mounted with inclination relative to the holding member 104 according to the embodiment of the present invention.

The regulating portion 107 of the holding member 104 according to the present embodiment regulates the posture of the liquid storage container 201 during the process of inserting the liquid storage container 201 into the holding member, that is, more specifically, an inclination angle of the posture relative to the direction of insertion (the direction A). As shown in FIG. 3C, by regulating the inclination angle to be smaller, even if the liquid storage container 201 is in an inclined posture, the liquid storage container 201 can be inserted to the locking position before contacting the inner wall of the holding member 104 on the rear side in the direction of insertion.

Figure 5:
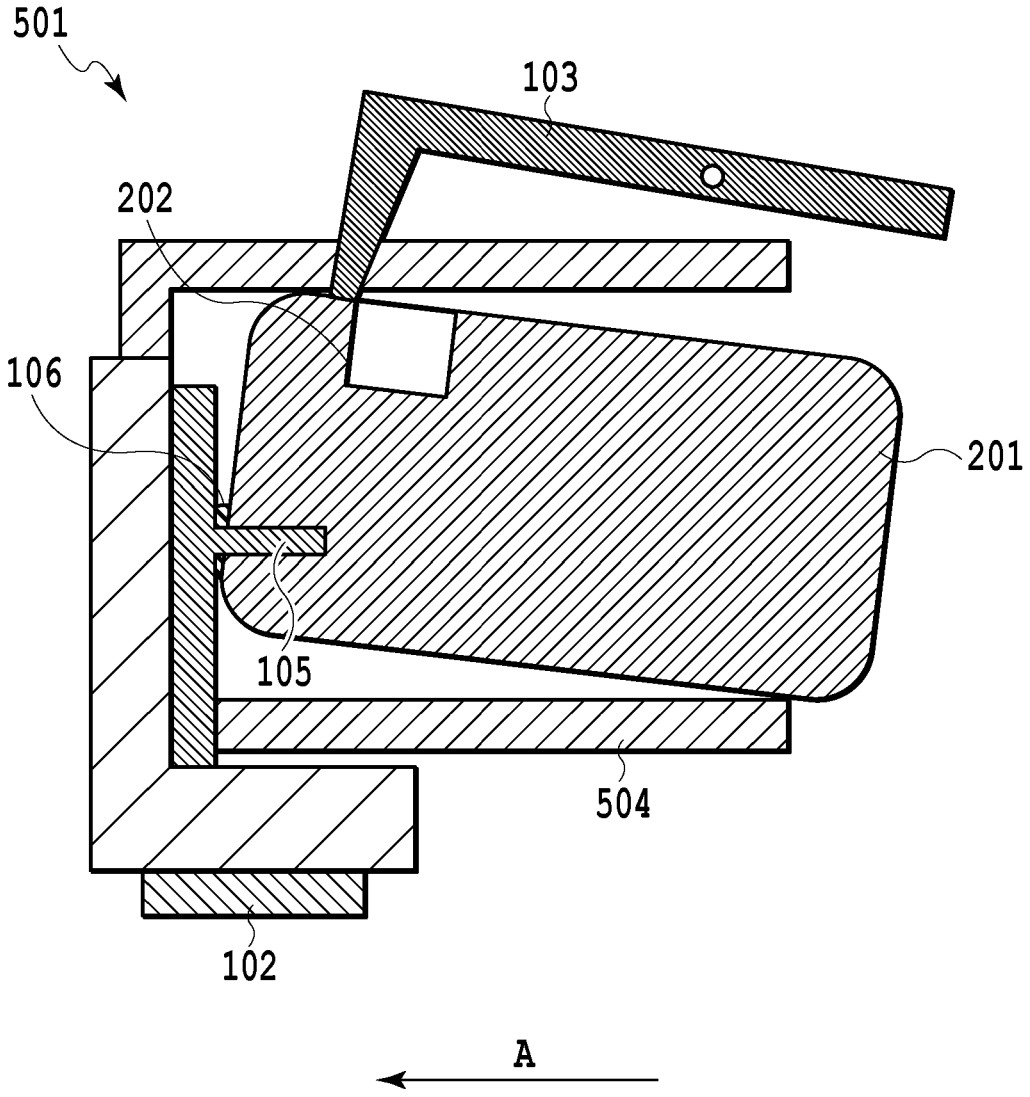
FIG. 5 is a schematic view explaining mounting of a liquid storage container on a traditional head.

With reference to FIG. 5, the effects of the present invention will be explained understandably. FIG. 5 shows a liquid ejection head 501 of an example of prior art. Since a holding member 504 of a liquid ejection head 501 of the example of prior art does not have the regulating portion 107, in a case where the posture of the liquid storage container 201 is inclined relative to the direction of insertion (the direction A) by pressing at the time of insertion, the inclination may become relatively larger as compared to that of the embodiment of the present invention. In a case where the inclination is large, even if the liquid storage container 201 reaches an inner wall on a rear side in the holding member 504 by pressing, the liquid storage container 201 cannot reach a position where the locking member 103 can be fitted to the recess 202, and creates a state in which the locking member 103 cannot be fitted to the recess 202. Meanwhile, in the embodiment of the present invention, by having the regulating portion 107 for regulating the posture of the liquid storage container 201 during the process of insertion, such a state can be avoided.

Figure 4:
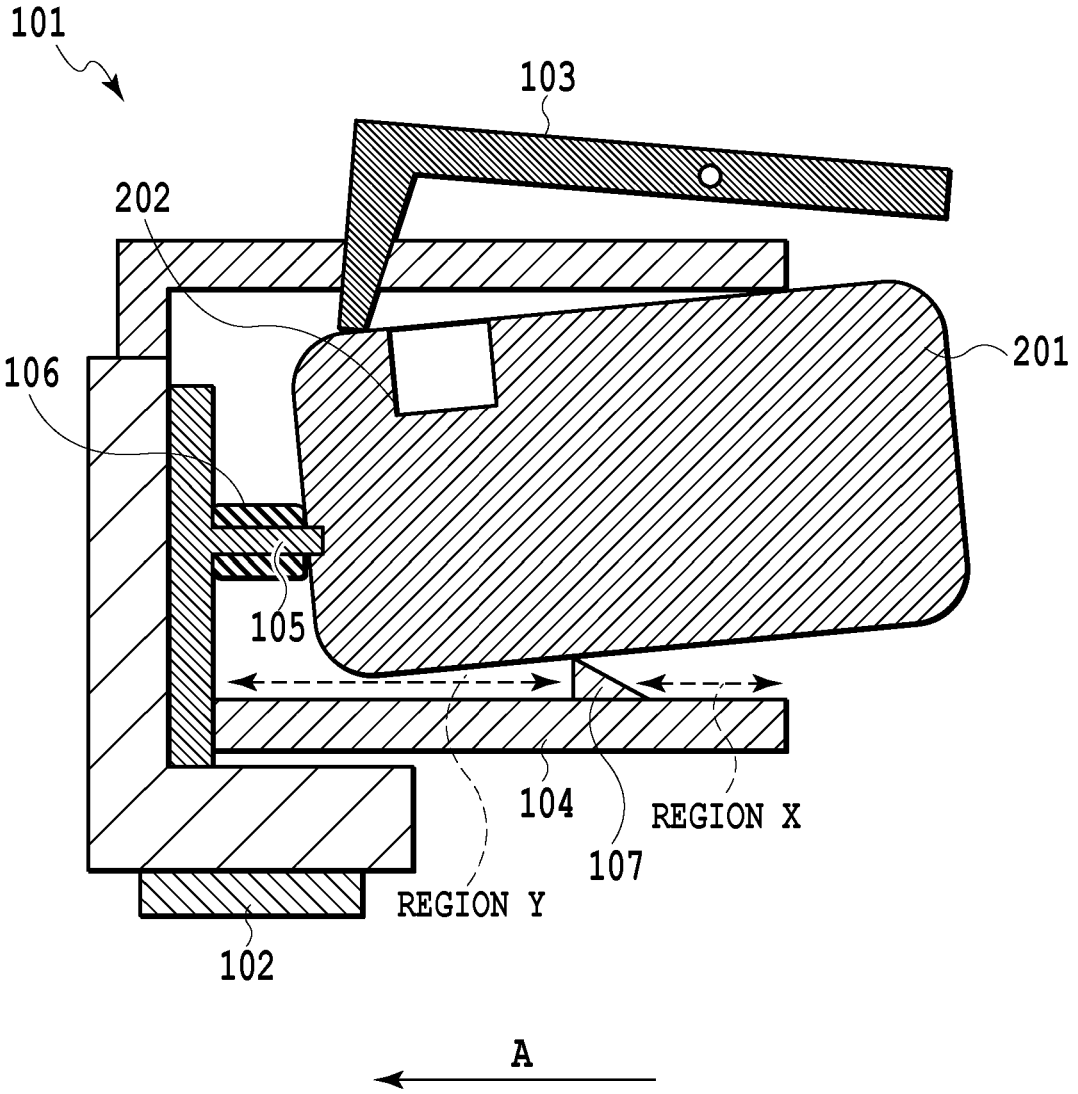
FIG. 4 is a schematic view of a state in the middle of inserting the liquid storage container into the head according to the embodiment.

With reference to FIG. 4, a configuration according to the embodiment of the present invention and exemplary modifications thereof will be described in detail.

As described above, the regulating portion 107 of the present invention regulates, during the process of inserting the liquid storage container 201 into the holding member 104, the posture of the liquid storage container 201 such that the inclination angle relative to the direction of insertion becomes small. For such a purpose, the regulating portion 107 is provided as a portion projecting inwardly in the interior space of the holding member into which the liquid storage container is inserted so as to reduce partially, along the direction of insertion, the space between an outer surface of the liquid storage container 201 and an inner surface of the holding member 104 facing thereto. In other words, the regulating portion 107 is provided such that the cross-sectional area of the interior space through which the liquid storage container passes is smaller than the area of an opening face of the opening of the holding member 104 in a region where the regulating portion 107 is located.

As shown in FIG. 4, the regulating portion 107 according to the embodiment of the present invention is provided on a near side of the locking member 103 in the direction of insertion (the direction A). Further, the regulating portion 107 is provided as a projection having a highest projecting portion in a region between the opening face of the opening of the holding member 104 and the inner wall on the rear side, in the direction of insertion, in the holding member 104.

For preventing the insertion of the liquid storage container 201 from being interrupted by being caught at the time of insertion, the highest projecting portion of the regulating portion 107 is located on a rear side than the opening face of the opening of the holding member 104. The regulating portion 107 is preferably formed in a slope in which the height thereof gradually increases toward the direction of insertion, from an opening face side thereof to the highest projecting portion in an area where the regulating portion 107 is located.

Further, for securing the easiness of insertion of the liquid storage container 201 during the process of insertion, the regulating portion 107 of the present invention is preferably provided in a form such that an area contacting the liquid storage container 201 to be inserted is as small as possible to reduce the sliding resistance.

More specifically, the highest projecting portion of the regulating portion 107 of the present invention is preferably partially provided in a direction crossing the direction of insertion (the direction A). For instance, one regulating portion 107 may be provided as a portion having a geometry such as a slit, groove, or dot on the surface thereof. Also, a plurality of regulating portions 107 may be provided by arranging the regulating portions in such a form as a platform and a rib. Specifically, as shown in FIGS. 1A and 1B, the regulating portion 107 according to the present embodiment is provided as one or two projections for each of the liquid storage containers in the direction crossing the direction of insertion (the direction A).

In other words, the regulating portion 107 of the present invention may be provided in such a manner as to project within the width of the liquid storage container in the direction crossing the direction of insertion (the direction A) in the area where the regulating portion is located. In this case, the regulating portion 107 may be provided partially on a center portion within the width of the liquid storage container, thereby suppressing the resistance at the time of mounting. Further, the regulating portion 107 may also be plurally provided within the width of the liquid storage container and the plurality of regulating portions 107 may be provided in positions symmetrically in the width direction of the liquid storage container. In the present invention, the number of the regulating portions 107 and the number of the highest projecting portions of the regulating portion 107 are not limited.

Moreover, the highest projecting portion of the regulating portion 107 of the present invention may be continuously or discontinuously provided through to the rear side in the direction of insertion of the holding member 104 with respect to the direction of insertion (the direction A). That is, an embodiment in which the highest projecting portion of the regulating portion 107 extends (for example, a platform shape, a rib shape, and the like) within a region Y shown in FIG. 4 may be possible.

However, in the present invention, the highest projecting portion of the regulating portion 107 is preferably provided partially in the direction of insertion (the direction A). Specifically, in the embodiment shown in FIG. 4, for example, the regulating portion 107 is provided as a projection partially projecting. Therefore, with respect to the direction of insertion (the direction A), a portion on the rear side (the region Y) relative to the highest projecting portion of the regulating portion 107 as well as a portion on the near side (a region X) relative to the regulating portion 107 has the larger cross-sectional area of the interior space through which the liquid storage container passes as compared to the cross-sectional area of the area where the regulating portion 107 is located.

According to the embodiment in which the regulating portion 107 is formed in such a projection shape, since the regulating portion 107 less contacts the liquid storage container 201 in the direction of insertion, a phenomenon in which the motion of the liquid storage container 201 is regulated to be small due to a reduced space between the liquid storage container 201 and the holding member 104 is suppressed.

More advantageously, the regulating portion partially projecting allows the direction of insertion of the liquid storage container 201 to be altered in the middle of insertion. That is, the liquid storage container 201 contacts the highest projecting portion of the regulating portion 107 and can vary, having the contact point as a support point, the inclination of the posture relative to the original direction of insertion. The liquid storage container 201 can be inserted while the inclination of the posture thereof relative to the holding member 104 is finely adjusted, and thus can easily reach the locking position where the locking member 103 can be fitted to the recess 202.

As described above, according to the configuration of the present invention, the inclination of the posture of the liquid storage container 201 relative to the direction of insertion can be reduced during the process of insertion, and whereby even in a case where the inner dimension of the holding member is made relatively larger than the outer dimension of the liquid storage container for easier mounting, the angle of insertion of the liquid storage container can be regulated, thereby enabling the mounting of the liquid storage container with accuracy. Further, before the liquid storage container 201 bumps into the rear end of the holding member 104, the locking member 103 can be fitted to the recess 202.

Therefore, according to the present invention, mounting of the liquid storage container can be performed by surely inserting the liquid storage container to the locking position irrespective of the direction of pressing at the time of insertion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-170353 filed on Aug. 25, 2014, which is hereby incorporated by reference herein in its entirety.

What is claimed is:

1. A holding member for a liquid storage container, comprising:

a mounting portion for removably mounting the liquid storage container through an opening along a predetermined direction of insertion;

a locking member having a locking portion for locking the liquid storage container by engaging with the liquid storage container and provided on an upper surface of the mounting portion for locking the mounted liquid storage container to the mounting portion by being fitted to the liquid storage container;

a regulating portion provided on a lower surface of the mounting portion as a projection extending toward the upper surface, the regulating portion being a portion provided such that a space between an inner surface of the mounting portion and an outer surface of the liquid storage container facing thereto is partially narrowed along the direction of insertion; and a liquid supply portion provided on a front surface with respect to the direction of insertion of the liquid storage container and connected to a liquid supply port of the liquid storage container for supplying a liquid in the liquid storage container to a liquid ejection head, wherein the regulating portion, the locking portion and the liquid supply portion are arranged in the order as listed with respect to the direction of insertion.

2. The holding member according to claim 1, wherein the regulating portion is provided in a region between an opening face of the opening of the mounting portion and the locking member with respect to the direction of insertion.

3. The holding member according to claim 1, wherein the regulating portion is positioned on a rear side of an opening face of the opening of the mounting portion in the direction of insertion.

4. The holding member according to claim 1, wherein the regulating portion is provided as a projection partially having a highest projecting portion on a rear side of an opening face of the opening of the mounting portion in the direction of insertion.

5. The holding member according to claim 1, wherein the regulating portion is provided as a projection whose highest projecting portion extends on a rear side of an opening face of the opening of the mounting portion in the direction of insertion.

6. The holding member according to claim 1, wherein the regulating portion is formed in a slope in which a height gradually increases in the direction of insertion, from an opening face side of the opening to a highest projecting portion.

7. The holding member according to claim 1, wherein the regulating portion, which is one in number, is provided in a direction crossing the direction of insertion.

8. The holding member according to claim 1, wherein a plurality of regulating portions are provided in a direction crossing the direction of insertion.

9. A liquid ejection head for mounting a holding member for a liquid storage container, the holding member comprising:

a mounting portion for removably mounting the liquid storage container through an opening along a direction of insertion;

a locking member having a locking portion for locking the liquid storage container by engaging with the liquid storage container and provided on an upper surface of the mounting portion for locking the mounted liquid storage container to the mounting portion by being fitted to the liquid storage container;

a regulating portion provided on a lower surface of the mounting portion as a projection extending toward the upper surface, the regulating portion being a portion provided such that a space between an inner surface of the mounting portion and an outer surface of the liquid storage container facing thereto is partially narrowed along the direction of insertion; and a liquid supply portion provided on a front surface with respect to the direction of insertion of the liquid storage container and connected to a liquid supply port of the liquid storage container for supplying a liquid in the liquid storage container to the liquid election head, wherein the regulating portion, the locking portion and the liquid supply portion are arranged in the order as listed with respect to the direction of insertion, and wherein the liquid storage container locked to the mounting portion is in fluid communication with the liquid ejection head.

10. The liquid ejection head according to claim 9, wherein the regulating portion is provided in a region between an opening face of the opening of the mounting portion and the locking member with respect to the direction of insertion.

11. The liquid ejection head according to claim 9, wherein the regulating portion is provided as a projection partially having a highest projecting portion on a rear side of an opening face of the opening of the mounting portion in the direction of insertion.

12. The liquid ejection head according to claim 9, wherein the regulating portion is formed in a slope in which a height gradually increases in the direction of insertion, from an opening face side of the opening to a highest projecting portion.

13. A printer for performing printing by using a liquid ejection head for mounting a holding member for a liquid storage container, the holding member comprising:

a mounting portion for removably mounting the liquid storage container through an opening along a direction of insertion;

a locking member having a locking portion for locking the liquid storage container by engaging with the liquid storage container and provided on an upper surface of the mounting portion for locking the mounted liquid storage container to the mounting portion by being fitted to the liquid storage container;

a regulating portion provided on a lower surface of the mounting portion as a projection extending toward the upper surface, the regulating portion being a portion provided such that a space between an inner surface of the mounting portion and an outer surface of the liquid storage container facing thereto is partially narrowed along the direction of insertion; and a liquid supply portion provided on a front surface with respect to the direction of insertion of the liquid storage container and connected to a liquid supply port of the liquid storage container for supplying a liquid in the liquid storage container to the liquid ejection head, wherein the regulating portion, the locking portion and the liquid supply portion are arranged in the order as listed with respect to the direction of insertion, and wherein the liquid storage container locked to the mounting portion is in fluid communication with the liquid ejection head.

14. The printer according to claim 13, wherein the regulating portion is provided in a region between the opening face of the opening of the mounting portion and the locking member with respect to the direction of insertion.

15. The printer according to claim 13, wherein the regulating portion is provided as a projection partially having a highest projecting portion on a rear side of an opening face of the opening of the mounting portion in the direction of insertion.

16. The printer according to claim 13, wherein the regulating portion is formed in a slope in which a height thereof gradually increases in the direction of insertion, from an opening face side of the opening to a highest projecting portion.

* * * * *